US006855029B2

(12) United States Patent
Rothman

(10) Patent No.: US 6,855,029 B2
(45) Date of Patent: Feb. 15, 2005

(54) STRETCHABLE NURSING TANK TOP WITH INVISIBLE BREAST SUPPORT

(76) Inventor: Line Rothman, 2 Laurel St., Rye, NY (US) 10580

( * ) Notice: Subject to any disclaimer, the term of this patent is extended or adjusted under 35 U.S.C. 154(b) by 0 days.

(21) Appl. No.: 10/398,433

(22) PCT Filed: Oct. 3, 2001

(86) PCT No.: PCT/US01/30818

§ 371 (c)(1),
(2), (4) Date: Jun. 30, 2003

(87) PCT Pub. No.: WO02/30221

PCT Pub. Date: Apr. 18, 2002

(65) Prior Publication Data

US 2004/0143885 A1 Jul. 29, 2004

Related U.S. Application Data

(60) Provisional application No. 60/238,602, filed on Oct. 6, 2000.

(51) Int. Cl.[7] ..... A41C 3/00
(52) U.S. Cl. ..... 450/36; 2/104; 2/69
(58) Field of Search ..... 2/69, 104–106, 2/73, 78.1–78.4, 113, 114, 115, 119–121, 80, 83, 79, 108, 109, 110, 85, 94, 95, 96; 450/36, 37, 30, 31, 32, 34, 35, 7–16

(56) References Cited

U.S. PATENT DOCUMENTS 232,246 A 9/1880 Duenckel
778,014 A 12/1904 Coyle
890,614 A 6/1908 Culver
2,679,048 A 5/1954 Alberts
2,911,650 A 11/1959 Culver
2,928,396 A 3/1960 O'Dell
3,176,692 A * 4/1965 Marino ..... 450/30
3,611,439 A 10/1971 Meyers (List continued on next page.)

*Primary Examiner*—Gloria M. Hale
(74) *Attorney, Agent, or Firm*—Allan Jacobson

(57) ABSTRACT

A form fitting nursing tank top/undershirt made with a stretch fabric includes an invisible build in nursing bra. The invisible nursing bra is partly internal and partly external. The external portion of the build in nursing bra is the left and right shoulder straps which from outside appearances form an integral part of the tank top/undershirt. The internal portion of the built in nursing bra is formed by a soft cup frame attached at the bottom to an elastic chest band and attached at the top to the front of the shoulder straps. In the back of the garment, the elastic chest band is attached to an internal back piece of fabric on the inside of the tank top. The internal back piece of fabric extends upward from the elastic chest band to the shoulder straps at the back, which shoulder straps each include an adjustable length section. Internal nursing flaps are attached at the bottom to the soft cup frame and at the top to the tank top body which forms external nursing flaps. The tank top/undershirt includes a continuous stretch body extending upward from the torso and forming the external nursing flaps which are attached to the internal nursing flaps and to the shoulder straps, to give a smooth single piece garment appearance.

19 Claims, 2 Drawing Sheets

U.S. PATENT DOCUMENTS

| | | | | | |
|---|---|---|---|---|---|
| 4,208,743 | A | | 6/1980 | Whitcraft | |
| 4,372,320 | A | | 2/1983 | Silber | |
| 4,390,024 | A | | 6/1983 | Williams | |
| 4,398,538 | A | | 8/1983 | Johnson | |
| 4,440,174 | A | * | 4/1984 | Cordova | 450/31 |
| 4,528,699 | A | | 7/1985 | Hughes | |
| 4,564,015 | A | | 1/1986 | Friedman | |
| 4,633,876 | A | | 1/1987 | Scullin | |
| 4,648,404 | A | * | 3/1987 | Clark | 450/31 |
| 4,663,782 | A | | 5/1987 | Knox et al. | |
| 4,878,879 | A | | 11/1989 | Kunstadter | |
| 4,911,677 | A | | 3/1990 | White | |
| 5,024,628 | A | | 6/1991 | Sanchez | |
| 5,033,986 | A | | 7/1991 | Feigenbaum et al. | |
| 5,045,018 | A | | 9/1991 | Costanzo | |
| 5,094,647 | A | | 3/1992 | Courtney | |
| 5,103,501 | A | | 4/1992 | Meisels | |
| 5,182,813 | A | | 2/1993 | Booze | |
| 5,274,852 | A | | 1/1994 | Hogan | |
| 5,380,238 | A | | 1/1995 | Crew-Gee | |
| 5,461,725 | A | | 10/1995 | Witczak | |
| 5,485,658 | A | | 1/1996 | Fildan | |
| 5,592,692 | A | | 1/1997 | Larson | |
| 5,611,086 | A | | 3/1997 | Eggen | |
| 5,624,296 | A | | 4/1997 | Weber-Unger | |
| 5,848,439 | A | | 12/1998 | Huseth et al. | |
| 6,074,273 | A | | 6/2000 | Turner et al. | |
| 6,083,079 | A | | 7/2000 | Pearson | |
| 6,162,111 | A | | 12/2000 | Heroff | |
| 6,282,719 | B1 | | 9/2001 | Vera et al. | |
| 6,346,027 | B1 | * | 2/2002 | Merkovsky | 450/37 |
| D462,156 | S | | 9/2002 | Loussier et al. | |
| 6,443,805 | B1 | * | 9/2002 | Kirkwood | 450/31 |
| 6,645,041 | B2 | * | 11/2003 | Sørensen | 450/36 |

* cited by examiner

STRETCHABLE NURSING TANK TOP WITH INVISIBLE BREAST SUPPORT

This application is a provisional application Ser. No. 60/238,602, filed Oct. 6, 2000.

FIELD OF THE INVENTION

The present invention relates to clothing for nursing mothers.

BACKGROUND OF THE INVENTION

A nursing bra typically includes features that permit a nursing mother to conveniently and comfortably access the breast in order to breast feed her baby.

For example, U.S. Pat. No. 6,083,079 shows a brassiere with a folding cup which is released by opening a closure at the top of the cup and folding the cup downward to access the breast. Another example is shown in U.S. Pat. No. 4,878,879 in which a specialized closure device fastens a folding cup to a nursing bra. All nursing brassieres are worn beneath an outer garment, which also must be moved aside to gain access to the folding cup of the nursing bra. U.S. Pat. No. 4,648,404 shows pair of separate but coordinated nursing undergarments, i.e., a complete bra and a complete slip that work together. An outer garment is still required. Specialized nursing clothing used as outer garments have odd-looking slits and openings and are typically available in enormous sizes.

U.S. Pat. No. 5,461,725 is typical of a specialized outer garment intended for a nursing mother. While nursing garment provides access to the mother's breast for feeding purposes, the garment fails to provide the important breast support needed by a nursing mother. As a consequence, nursing bras are often still required to be worn underneath the typical nursing outer garment.

Yet, for economy, flexibility and style, many women would prefer to wear normal everyday clothing with a nursing bra underneath. However, many common articles of clothing such as a woman's shirt or top are awkward to use with a typical nursing bra. For example, unbuttoning a blouse in public or semi-public settings is an awkward movement. Indecorous motions that attract attention often accompany accessing the nursing undergarment through regular clothing. As another example, lifting a shirt or sweater at the bottom edge of the garment to reach the nursing bra awkwardly exposes skin in the midsection or stomach area.

SUMMARY OF THE INVENTION

The invention is embodied in a tank top/undershirt with invisible breast support for nursing mothers. In particular, a form fitting stretch fabric tank top/undershirt includes left and right external fabric nursing flaps (breast covers), which attach and release to respective left and right shoulder straps just above the breast. The tank top/undershirt includes a built in nursing bra that is partly internal and partly external.

The external portion of the built in nursing bra is the left and right shoulder straps, which from outside appearances are an integral part of the tank top/undershirt. Thus, the tank top/undershirt looks smooth on the outside with no outer cups. Only the exteriors of fasteners are visible, and some hidden types of fasteners are nearly impossible to detect.

The tank top/undershirt of the present invention is a complete connected unit so that during nursing there is no loose shoulder strap to get lost underneath other layers of clothing. When lifting any outer garment shirt of any style by its bottom edge, the tank top/undershirt of the present invention keeps the stomach covered while the mother opens and closes the nursing flaps. The nursing flaps conveniently detach and fold down underneath the outer clothing. The built in bra mechanism gives full breast support and the stretchable material lets the tank top/undershirt shrink to match the weight loss typical after the birth of the baby. The elastic stretch fabric body of the tank top/undershirt also provides firm stomach support.

A nursing mother can maintain her own style without having to wear nursing clothes with odd-looking slits and openings, in enormous sizes. The invented garment may be worn as a tank top by itself, or worn underneath regular clothing. The present invented garment provides for absolute discretion, easy access for the baby to nurse, with no awkward movements to adjust shoulder straps, and with the maximum important support that is needed for the breasts and the body.

DETAILED DESCRIPTION

Figure 1:
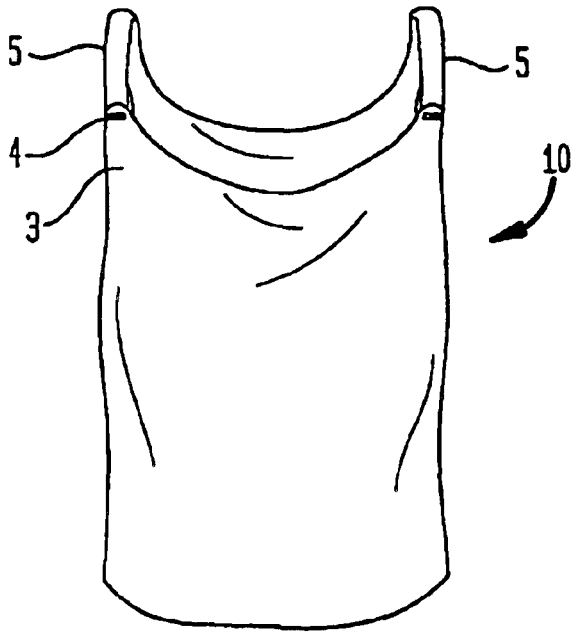
FIG. 1 is an external front view with nursing flaps closed of a nursing tank top/undershirt in accordance with the present invention.
Figure 2:
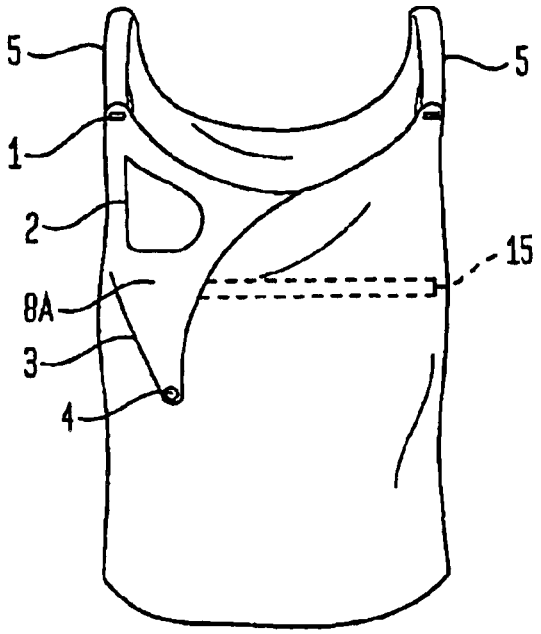
FIG. 2 is an external front view with one nursing flap open of a nursing tank top/undershirt in accordance with the present invention.

The front view of the nursing tank top/undershirt 10 shown in FIG. 1 includes external nursing flaps 3, which fasten 4 to shoulder straps 5. In FIG. 2, the external nursing flap 3 is shown in an open position, revealing a soft cup breast support 2, an inner fastener 1 and an internal nursing flap 8A. When the external nursing flap 3 and internal nursing flap 8A are closed, the inner fastener 1 couples with the outer fastener 4. An internal elastic chest band 15 is positioned just below the soft cup breast support 2.

Figure 3:
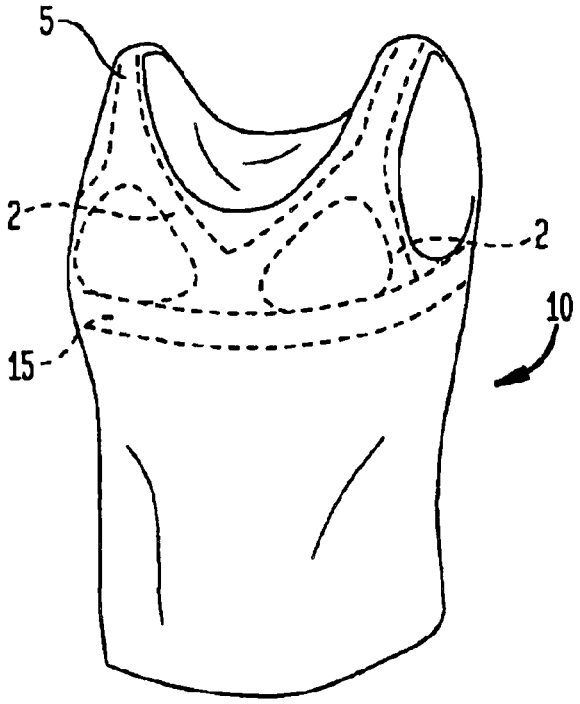
FIG. 3 is an isometric view of a nursing tank top/undershirt with the internal construction details shown in phantom in accordance with the present invention.

FIG. 3 illustrates the built in nursing bra hidden inside the tank top/undershirt 10. The internal elastic chest band 15 is attached to the soft cup frame 2, which is in turn attached to the shoulder straps 5.

Figure 4:
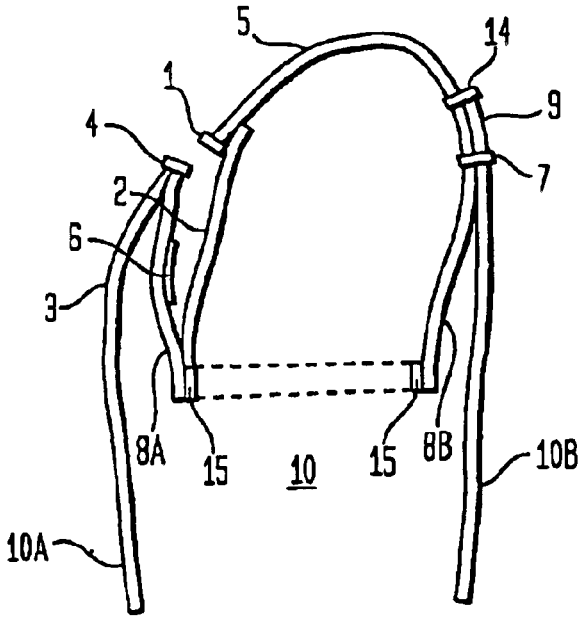
FIG. 4 is a cross sectional side view of a nursing tank top/undershirt in accordance with the present invention.

As indicated, the tank top/undershirt 10 of the present invention includes a built in nursing bra that is partly internal and partly external. More specifically, in FIG. 4, a built in nursing bra is formed by a soft cup frame 2 attached at the bottom to an elastic chest band 15 and attached via short straps at the top to the front of the shoulder straps 5. In the back, the elastic chest band 15 is attached to an internal back piece of fabric 8B on the inside of the tank top 10. The internal back piece of fabric 8B extends upward from the elastic chest band 15 to the shoulder straps 5 at the back. The shoulder straps 5 include an adjustable section 9 shown in schematic form. Adjustment devices 7, 14 are provided for adjusting the length of one section 9 of the shoulder strap 5.

Internal nursing flaps 8A are attached to the bottom of the soft cup frame 2. When closed, the internal nursing flaps BA directly cover the breasts and are attached to the shoulder straps 5 at the top of the soft cup frame 2. The internal nursing flap 8A may include a provision for placement of a nursing pad 6. External nursing flaps 3 are attached to the internal nursing flaps 8A at the top of both nursing flaps, where a fastener 4 is located. Both internal and external nursing flaps BA, 3 cover the breasts when fastener 4 is coupled to the shoulder straps 5 by fastener 1 at the top of the soft cup frame 2. The nursing flap fasteners 1 and 4 are shown in schematic form to represent any type of fastener. Preferably, the fasteners 1, 4 should be of a hidden type so that the external nursing flap 3 and the shoulder strap 5 appear to be one continuous garment.

The outer garment of the tank top/undershirt includes a stretch body wrap 10A, 10B extending upward from the torso and forming the external nursing flaps 3 which are attached to the internal nursing flaps 8A and to the shoulder straps 5 to give a smooth single garment appearance. The front 10A and back 10B (i.e., the body wrap portion) of the tank top/undershirt 10 is made of an elastic, stretchable fabric so as to form fit around the torso of the wearer.

The concealed internal nursing bra is formed partly by internal components and partly by external components. In particular, the tank top/undershirt 10 of the present invention has a built in invisible nursing bra formed by internal sections comprising the elastic chest band 15, the soft cup frame 2, the internal nursing flaps BA, and the back piece of fabric 8B. For additional support, nursing flaps 8A and the back piece of fabric 8B may alternatively be constructed using one piece of fabric extending around the torso, in the same manner that the elastic chest band extends around the torso. The shoulder straps 5 including the adjustable section 9 form the external portion of the invisible nursing bra. Externally, the shoulder straps 5 appear to be part of the tank top/undershirt and do not appear to be part of a nursing bra.

In use, the wearer adjusts the length 9 of the straps 5 of the tank top 10 for snug fit. The internal and external nursing flaps 8A, 3 cover the soft cup frame 2 when the fasteners 1, 4 are closed. The internal fabric flaps 8A can also have a pocket made of netting or of the same fabric material as the tank top to hold a nursing pad 6 in its place. Fasteners 1 and 4 may be snaps, clasps or a hook and loop type fastener, in order to hold the internal and external fabric flaps 8A, 3, which cover the breasts and the soft cup frame 2. To nurse the baby, fasteners 1 and 4 are separated, and both internal and external nursing flaps 8A, 3 fold downward to access the breast. After feeding, the internal and external nursing flaps 8A, 3 are re-attached to the shoulder straps 5 by fasteners 1 and 4.

What is claimed is:

1. A nursing garment comprising:

a shoulder strap having a front end and a back end;

an elastic chest band having a front section and a back section;

a soft cup frame having a base and a top, said soft cup frame attached at said base thereof to said front section of said elastic chest band and attached at the top the thereof to said front end of said shoulder strap;

a back piece having a base edge thereof attached to said back section of said elastic band and a top edge thereof attached to said back end of said shoulder strap;

an internal nursing flap having a base and a top, said base thereof attached to said base of said soft cup frame;

a first fastener attached to said top of said internal nursing flap, and a second fastener attached to the front end of said shoulder strap, said first fastener adapted to fasten said top of said internal nursing flap to said second fastener; and an elastic stretch fabric body having a top front edge attached to said top of said internal nursing flap and a rear top edge attached to said back end of said shoulder strap.

2. A nursing garment in accordance with claim 1, wherein said shoulder strap includes an adjustable length portion therein.

3. A nursing garment in accordance with claim 1, wherein said top edge of said back piece is attached to said back end of said shoulder strap via an adjustable length section.

4. A nursing garment in accordance with claim 1, wherein said back piece back and internal nursing flap are one continuous piece of fabric.

5. A nursing garment comprising:

a nursing bra including a shoulder strap having a front region and a back region, an elastic chest band having a front section and a back section, said back region of said shoulder strap being coupled to said back section of section of said elastic chest band, a soft cup frame having a base arid a top, said soft cup frame attached at said base thereof to said front section of said elastic chest band and attached at the top thereof to said front region of said shoulder strap, an internal nursing flap having a base and a top, said base thereof attached to said base of said soft cup frame, a first fastener attached to said top of said internal nursing flap, and a second fastener attached to the front region of said shoulder strap, said first fastener adapted to fasten said top of said internal nursing flap to said second fastener; and a fabric body having a top front edge and a rear top edge, said top front edge attached to said top of said internal nursing flap and said rear top edge attached to said back region of said shoulder strap.

6. A nursing garment in accordance with claim 5, wherein said back region of said shoulder strap is coupled to said back section of said elastic chest band by a back piece having a base edge and a top edge, said base edge or said back piece being attached to said back section of said elastic band, and said top edge of said back piece being attached to said back region of said shoulder strap.

7. A nursing garment in accordance with claim 6, wherein said rear top edge or said fabric body is attached to said back region of said shoulder strap by attachment thereof to said top edge of said back piece.

8. A nursing garment in accordance with claim 6, wherein said top edge of said back piece is attached to said back section of said shoulder strap via an adjustable length section.

9. A nursing garment in accordance with claim 6, wherein said back piece back and internal nursing flap are one continuous piece of fabric.

10. A nursing garment in accordance with claim 5, wherein said fabric body is elastic stretch fabric.

11. A nursing garment in accordance with claim 5, wherein said shoulder strap includes an adjustable length portion therein.

12. A nursing garment comprising:

a nursing bra including a shoulder strap having a front region and a back region, an elastic chest band having a front section and a back section, said back region of said shoulder strap being coupled to said back section of section of said elastic chest band, a nursing breast cup having a base and a top, said nursing breast cup attached at said base thereof to said from section of said elastic chest band and attached at the top thereof to said front region of said shoulder strap, an internal nursing flap having a base and a top, said base thereof attached to said base of said nursing breast cup, a first fastener attached to said top of said internal nursing flap, and a second fastener attached to the front region of said shoulder strap, said first fastener adapted to fasten said top of said internal nursing flap to said second fastener; and a fabric body having a top front edge and a rear top edge, said top front edge attached to said top of said internal nursing flap and said rear top edge attached to said back region of said shoulder strap.

13. A nursing garment in accordance with claim 12, wherein said back region of said shoulder strap is coupled to said back section of said elastic chest band by a back piece having a base edge and a top edge, said base edge of said back piece being attached to said back section of said elastic band, and said top edge of said back piece being attached to said back region of said shoulder strap.

14. A nursing garment in accordance with claim 13, wherein said rear top edge of said fabric body is attached to said back region of said shoulder strap by attachment thereof to said top edge of said back piece.

15. A nursing garment in accordance with claim 13, wherein said top edge of said back piece is attached to said back section of said shoulder strap via an adjustable length section.

16. A nursing garment in accordance with claim 13, wherein said back piece back and internal nursing flap are one continuous piece of fabric.

17. A nursing garment in accordance with claim 12, wherein said fabric body is elastic stretch fabric.

18. A nursing garment in accordance with claim 12, wherein said shoulder strap includes an adjustable length portion therein.

19. A nursing garment in accordance with claim 12, wherein said nursing breast cup is a soft cup frame.

* * * * *

UNITED STATES PATENT AND TRADEMARK OFFICE

CERTIFICATE OF CORRECTION

PATENT NO. : 6,855,029 B2
DATED : February 15, 2005
INVENTOR(S) : Line Rothman

It is certified that error appears in the above-identified patent and that said Letters Patent is hereby corrected as shown below:

Title page,
Item [60], Related U.S Application Data, delete "This application is a provisional application Ser. No. 60/238,602, filed October 6, 2000." insert as follows:

-- CROSS REFERENCE TO RELATED APPLICATIONS

This application is a national phase patent application based on International patent application PCT\US01\30818, designating the United States of America, which claims priority from US provisional patent application serial no. 60/238,602, filed October 6, 2000. --

Signed and Sealed this

Seventh Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,855,029 B2
DATED : February 15, 2005
INVENTOR(S) : Line Rothman

It is certified that error appears in the above-identified patent and that said Letters Patent is hereby corrected as shown below:

Title page,
Item [60], Related U.S Application Data, reinstate "This application is a provisional application Ser. No. 60/238,602, filed October 6, 2000." (deleted by Certificate of Correction issued June 7, 2005).

Column 1,
Lines 4 and 5, delete and substitute therefor:

-- CROSS REFERENCE TO RELATED APPLICATIONS

This application is a national phase patent application based on International patent application PCT\US01\30818 with an international filing date of October 3, 2001 designating the United States of America, which claims priority from US provisional patent application serial no. 60/238,602, filed October 6, 2000. --

Signed and Sealed this

Thirteenth Day of September, 2005

JON W. DUDAS
*Director of the United States Patent and Trademark Office*

UNITED STATES PATENT AND TRADEMARK OFFICE

CERTIFICATE OF CORRECTION

PATENT NO. : 6,855,029 B2
DATED : February 15, 2005
INVENTOR(S) : Line Rothman

It is certified that error appears in the above-identified patent and that said Letters Patent is hereby corrected as shown below:

Title page,
Item [60], Related U.S. Application Data, reinstate "Provisional application No. 60/238,602, filed on October 6, 2000." (deleted by Certificate of Correction issued June 7, 2005).

Column 1,
Lines 4 and 5, delete and substitute therefor:

-- CROSS REFERENCE TO RLEATED APPLICATIONS

This application is a national phase continuation patent application based on International patent application PCT\US01\30818 with an international filing date of October 3, 2001 designating the United States of America, which claims priority from US provisional patent application serial no. 60/238,602, filed October 6, 2000. --.

This certificate supersedes Certificate of Correction issued June 7, 2005 and September 13, 2005.

Signed and Sealed this

Fourth Day of October, 2005

JON W. DUDAS
*Director of the United States Patent and Trademark Office*